US008199177B2

(12) United States Patent
Inagaki

(10) Patent No.: US 8,199,177 B2
(45) Date of Patent: Jun. 12, 2012

(54) IMAGE FORMING APPARATUS

(75) Inventor: Yoshihiro Inagaki, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 367 days.

(21) Appl. No.: 12/699,952

(22) Filed: Feb. 4, 2010

(65) Prior Publication Data

US 2010/0196029 A1 Aug. 5, 2010

(30) Foreign Application Priority Data

Feb. 5, 2009 (JP) ..... 2009-024605

(51) Int. Cl.
*B41J 2/435* (2006.01)

(52) U.S. Cl. ..... 347/236
(58) Field of Classification Search ..... 347/236, 347/237, 238, 240, 246, 247, 253; 345/63; 356/243.8
See application file for complete search history.

(56) References Cited

U.S. PATENT DOCUMENTS

| | | | | |
|---|---|---|---|---|
| 6,686,946 | B2 * | 2/2004 | Masuda et al. | 347/236 |
| 7,804,513 | B2 * | 9/2010 | Masuda | 347/236 |
| 8,130,374 | B2 * | 3/2012 | Karassiouk | 356/243.8 |
| 2002/0051052 | A1 | 5/2002 | Masuda et al. | |

FOREIGN PATENT DOCUMENTS

| | | | |
|---|---|---|---|
| JP | 2002-127492 | A | 5/2002 |
| JP | 2004-9581 | A | 1/2004 |

* cited by examiner

*Primary Examiner* — Huan Tran
(74) *Attorney, Agent, or Firm* — Buchanan Ingersoll & Rooney PC

(57) ABSTRACT

An electrophotographic image forming apparatus having an LED array with a plurality of light emitting elements aligned in a main-scanning direction and a convergent lens array for imaging light emitted from the light emitting elements on a photosensitive member. In order to correct density unevenness caused by positioning errors of the lens array, the light quantity emitted from each of the light emitting elements is adjusted such that the total difference from a target value will be closer to zero.

6 Claims, 15 Drawing Sheets

IMAGE FORMING APPARATUS

This application is based on Japanese patent application No. 2009-024605 filed on Feb. 5, 2009, of which content is incorporated herein by reference.

BACKGROUND OF THE INVENTION

1. Field of the Invention

The present invention relates to an image forming apparatus, and more particularly to an image forming apparatus that writes an image on a photosensitive member with light modulated in accordance with image data.

2. Description of Related Art

In the field of electrophotographic image forming apparatuses, it is conventionally known that light emitting points of an LED array that is used for image writing on a photosensitive member are individually corrected in light quantity so as to minimize density unevenness in a formed image (see Japanese Patent Laid-Open Publication No. 2002-127492).

Even when this measure is taken, however, if the resolution of light quantity correction data is low, the density unevenness will be still apparent. An improvement in the resolution of light quantity correction data requires a rise in cost.

SUMMARY OF THE INVENTION

An object of the present invention is to provide an image forming apparatus that writes images of high quality of which density unevenness is not apparent without a rise in cost.

In order to attain the object, an image forming apparatus according to an aspect of the present invention comprises: a light source comprising a plurality of light emitting elements aligned in a main-scanning direction; a convergent lens array for imaging light emitted from the light emitting elements on a photosensitive member; and a controller for adjusting each of the light emitting elements in light quantity such that a total difference from a target value will be closer to zero.

In the image forming apparatus, the resolution of light quantity correction data is low, and it is difficult to adjust the light quantity emitted from each of the light emitting elements precisely to the target value. However, the adjustment is carried out such that the total difference from the target value will be closer to zero, whereby the light quantity emitted from each light emitting element will become the target value. Thus, the density unevenness of an image formed by electrophotography can be minimized.

According to the present invention, it is possible to minimize the density unevenness of a formed image without improving the resolution of light quantity correction data, which is not costly.

BRIEF DESCRIPTION OF THE DRAWINGS

This and other objects and features of the present invention will be apparent from the following description with reference to the accompanying drawings, in which:

FIG. 3 is a schematic view showing a light quantity distribution on a photosensitive drum when only one light emitting element that has the first example of positional relationship with the rod lenses is turned on;

FIG. 4 is a schematic view showing a light quantity distribution in a position defocused by −0.15 mm when only one light emitting element that has the first example of positional relationship with the rod lenses is turned on;

FIG. 5 is a schematic view showing a light quantity distribution in a position defocused by 0.15 mm when only one light emitting element that has the first example of positional relationship with the rod lenses is turned on;

FIG. 7 is a schematic view showing a light quantity distribution on the photosensitive drum when only one light emitting element that has the second example of positional relationship with the rod lenses is turned on;

FIG. 8 is a schematic view showing a light quantity distribution in the position defocused by −0.15 mm when only one light emitting element that has the second example of positional relationship with the rod lenses is turned on;

FIG. 9 is a schematic view showing a light quantity distribution in the position defocused by 0.15 mm when only one light emitting element that has the second example of positional relationship with the rod lenses is turned on;

DETAILED DESCRIPTION OF THE PREFERRED EMBODIMENTS

Figure 1:
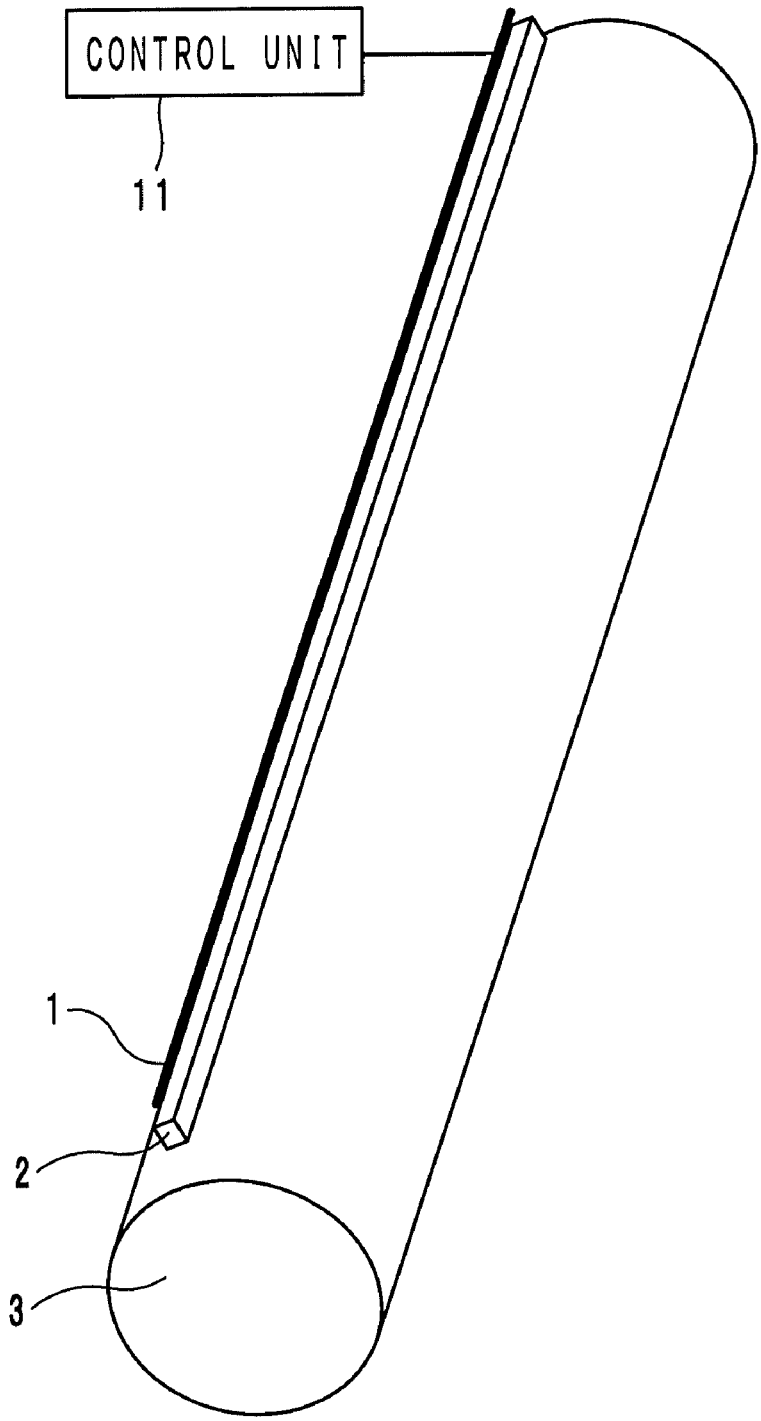
FIG. 1 is a schematic perspective view of an essential part of an image forming apparatus according to an embodiment of the present invention.

Image forming apparatuses according to preferred embodiments of the present invention are hereinafter described referring to the drawings.

Referring to FIG. 1, while a photosensitive drum 3 is driven to rotate in a specified direction, light modulated in accordance with image data is emitted from an LED array 1 and passes through a convergent lens array 2, so that an image (an electrostatic latent image) is written on the surface of the photosensitive drum 3. The LED array 1, which is of a conventional type, is a light source composed of a plurality of light emitting elements (LEDs) aligned in a main-scanning direction. The LED array 1 is controlled by a control unit 11, and the control unit 11 further carries out measurement and adjustment of the light quantity. The convergent lens array 2, which is of a conventional type, is composed of a plurality of rod lenses 2*a* (see FIGS. 2 and 6).

Figure 2:
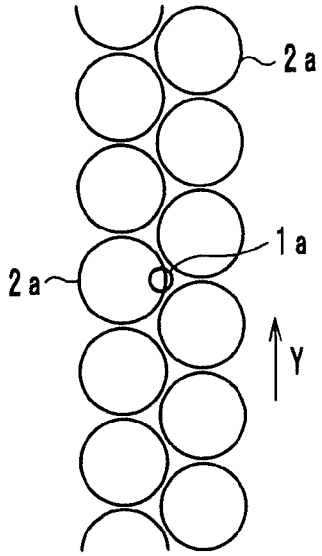
FIG. 2 is an illustration showing a first example of positional relationship between a light emitting element and rod lenses.
Figure 6:
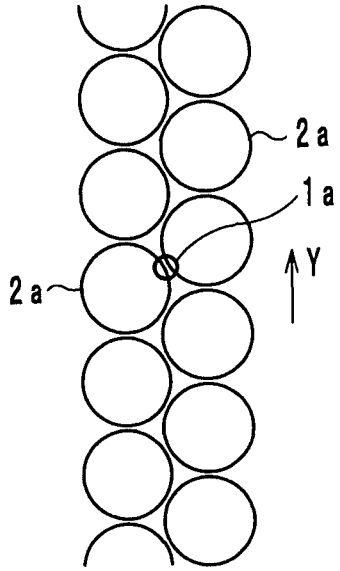
FIG. 6 is an illustration showing a second example of positional relationship between a light emitting element and rod lenses.

As shown in FIGS. 2 and 6, the light emitting elements 1*a* of the LED array 1 are arranged in the main-scanning direction Y at a pitch corresponding to the resolution, and the circles 1*a* in FIGS. 2 and 6 show the size of each light emitting point. The rod lenses 2*a* are relatively large compared with the light emitting points 1*a*. Therefore, the positional relationships of the respective light emitting points with the rod lenses 2*a* are like that shown by FIG. 2, that shown by FIG. 6 and intermediates between that shown by FIG. 2 and that shown by FIG. 6. In this embodiment, the resolution is 1200 dpi, and the light emitting elements (points) 1*a* are arranged at a pitch of 21 μm. The rod lenses 2*a* are 460 μm in diameter, and the distance between the respective centers of adjoining rod lenses 2*a* is 508 μm. In the arrangement, if an error is made in positioning the LED array 1, the convergent lens array 2 or the photosensitive drum 3, the light quantity distribution on the photosensitive drum 3 will shift from the designed pattern.

Figure 3:
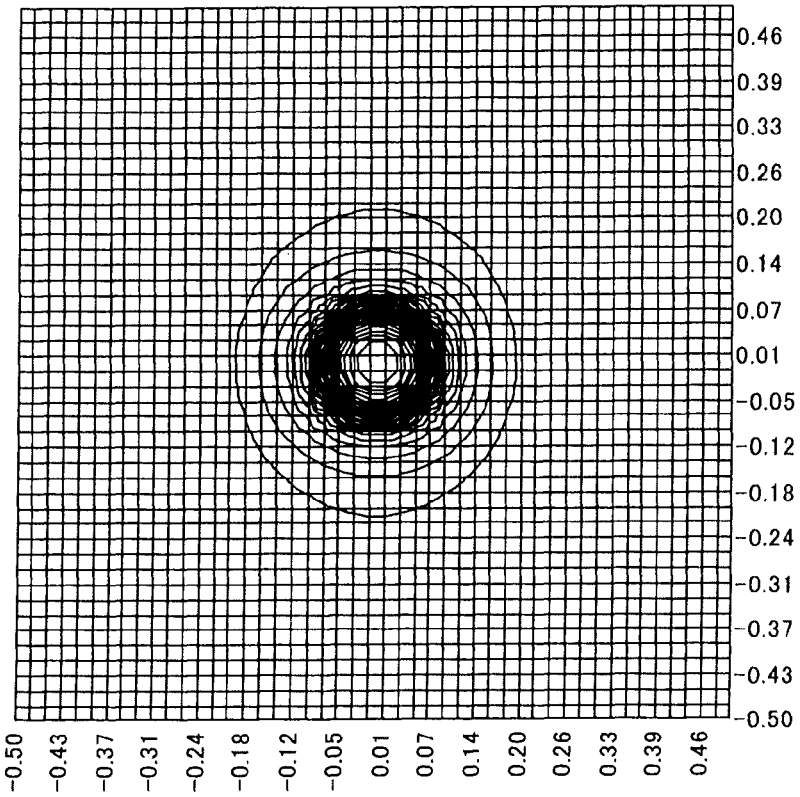
Figure 4:
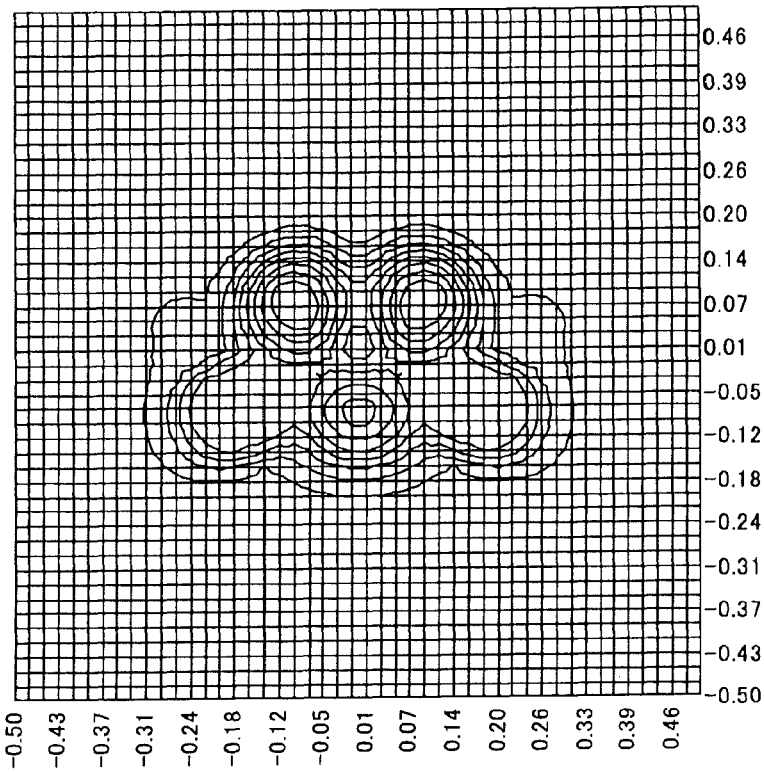
Figure 5:
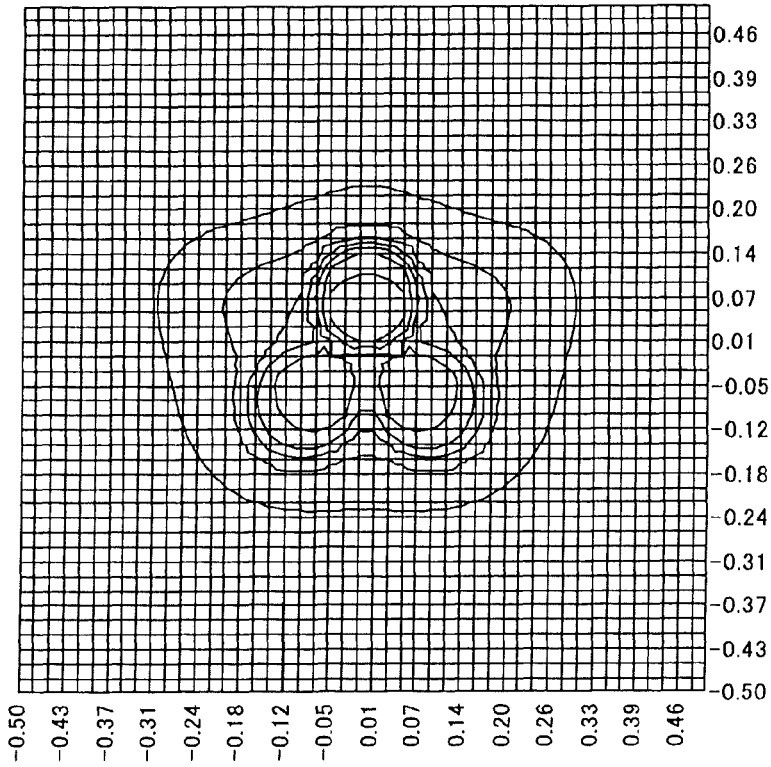

FIGS. 3, 4 and 5 show the light quantity distribution on the photosensitive drum 3 when only one light emitting element 1*a* that has a first example of positional relationship with the rod lenses 2*a* as shown by FIG. 2 is turned on. FIG. 3 shows the light quantity distribution on the photosensitive drum 3 when the surface of the photosensitive drum 3 is on the focal point. FIG. 4 shows the light quantity distribution in a position defocused by −0.15 mm (when the photosensitive drum 3 is shifted nearer to the lenses 2*a* by 0.15 mm). FIG. 5 shows the light quantity distribution in a position defocused by 0.15 mm (when the photosensitive drum 3 is shifted farther from the lenses 2*a* by 0.15 mm). As shown by FIGS. 4 and 5, the patterns of light quantity distributions in defocused positions correspond to the arrangement of the rod lenses 2*a*.

Figure 7:
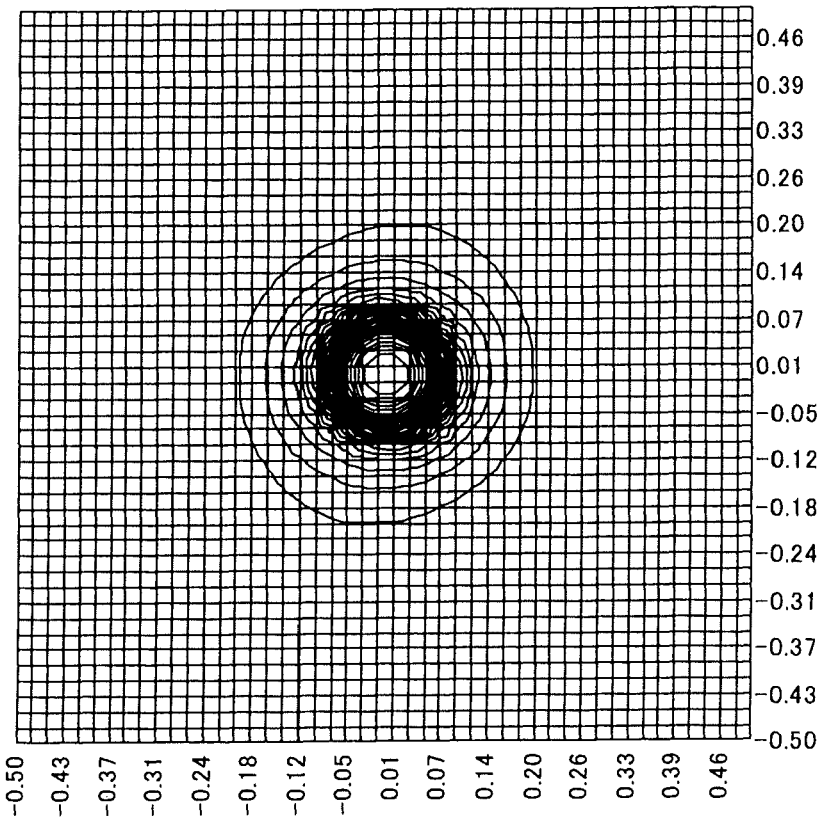
Figure 8:
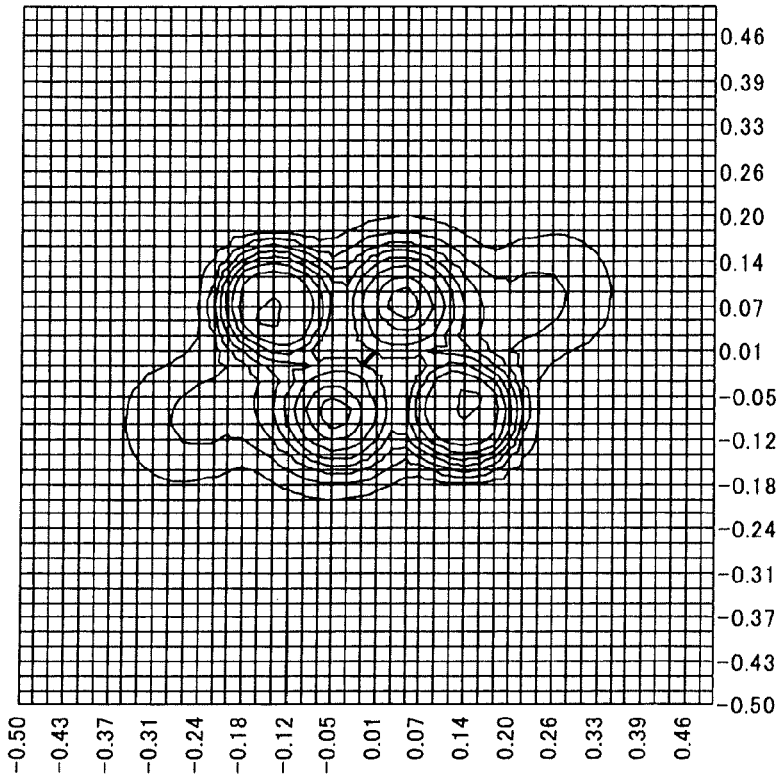
Figure 9:
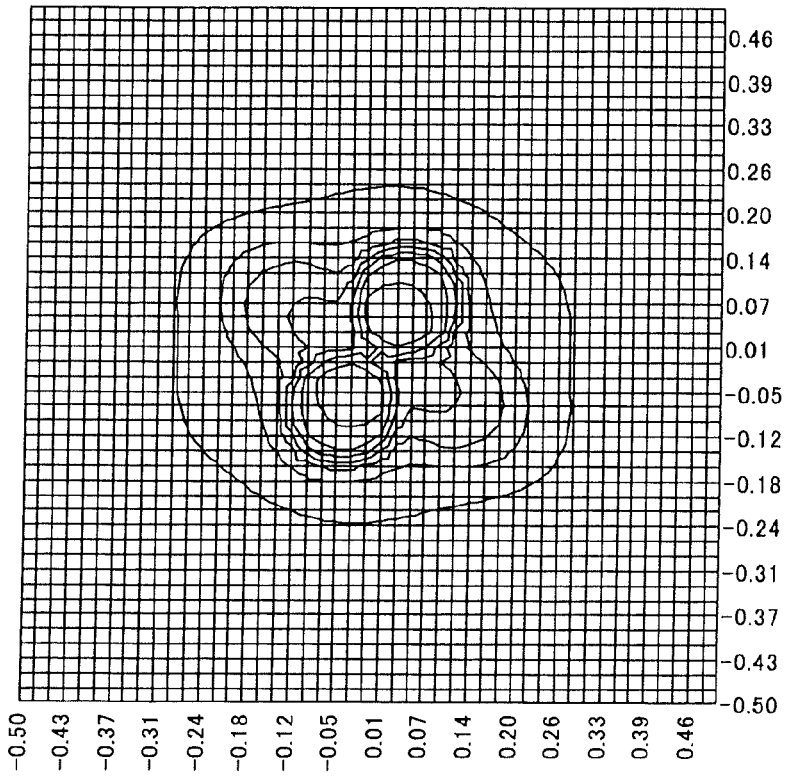

FIGS. 7, 8 and 9 show the light quantity distribution on the photosensitive drum 3 when only one light emitting element 1*a* that has a second example of positional relationship with the rod lenses 2*a* as shown by FIG. 6 is turned on. FIG. 7 shows the light quantity distribution on the photosensitive drum 3 when the surface of the photosensitive drum 3 is on the focal point. FIG. 8 shows the light quantity distribution in a position defocused by −0.15 mm (when the photosensitive drum 3 is shifted nearer to the lenses 2*a* by 0.15 mm). FIG. 9 shows the light quantity distribution in a position defocused by 0.15 mm (when the photosensitive drum 3 is shifted farther from the lenses 2*a* by 0.15 mm). As shown by FIGS. 8 and 9, the patterns of light quantity distributions in defocused positions correspond to the arrangement of the rod lenses 2*a*.

Figure 10:
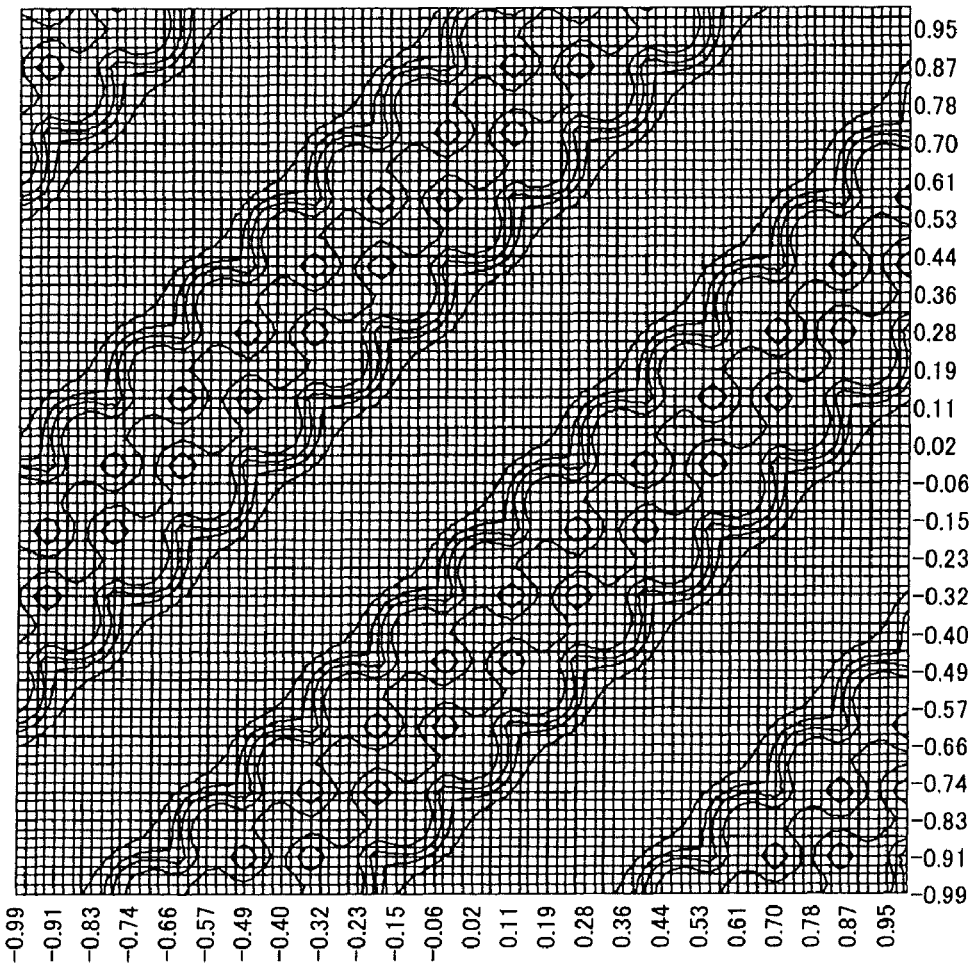
FIG. 10 is a schematic view showing a light quantity distribution on the photosensitive drum when a halftone image is written by 45-degree line screening.
Figure 11:
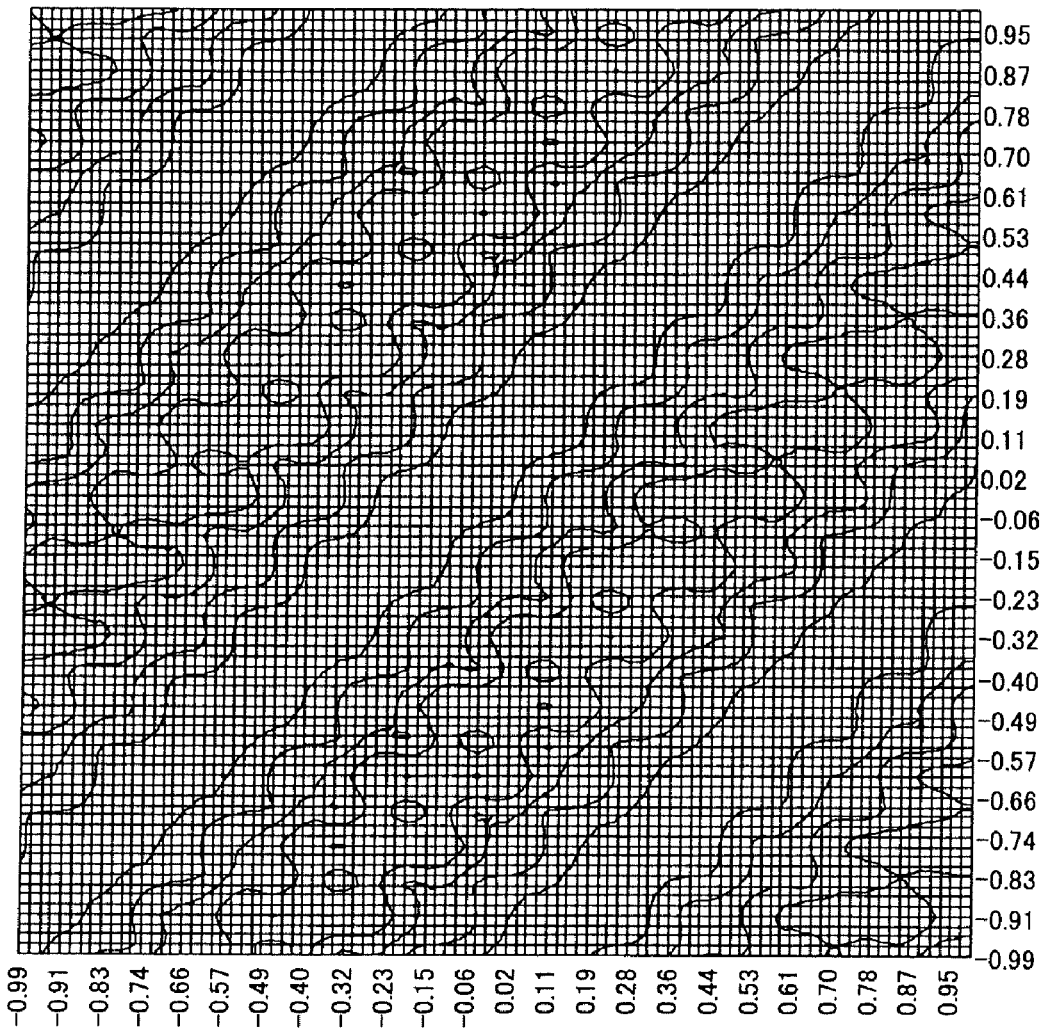
FIG. 11 is a schematic view showing a light quantity distribution in the position defocused by −0.15 mm when a halftone image is written by 45-degree line screening.

FIGS. 10 and 11 show light quantity distributions of a halftone image written on the photosensitive drum 3 by line screening. FIG. 10 shows the light quantity distribution when the surface of the photosensitive drum 3 is on the focal point. FIG. 11 shows the light quantity distribution when the surface of the photosensitive drum 3 is defocused by −0.15 mm. The light emitting points are aligned in the horizontal direction in FIGS. 10 and 11, and while the photosensitive drum 3 rotates in the vertical direction in FIGS. 10 and 11, the light emitting points are individually tuned on and off. Thereby, an image is written.

In order to write a halftone image with a uniform density, all the light emitting points are turned on and turned off at a constant rate. In the case shown by FIGS. 10 and 11, each of the light emitting points is turned on for four dots and turned off for next four dots. The light emitting points repeat this cycle individually.

When a rod lens 2*a* has an error, light passing through the rod lens 2*a* is influenced by the error, whereas light that does not pass through the rod lens 2*a* is not influenced by the error. Therefore, in this case, the convergence of light changes only in a limited area of an image, and density unevenness occurs.

Figure 12:
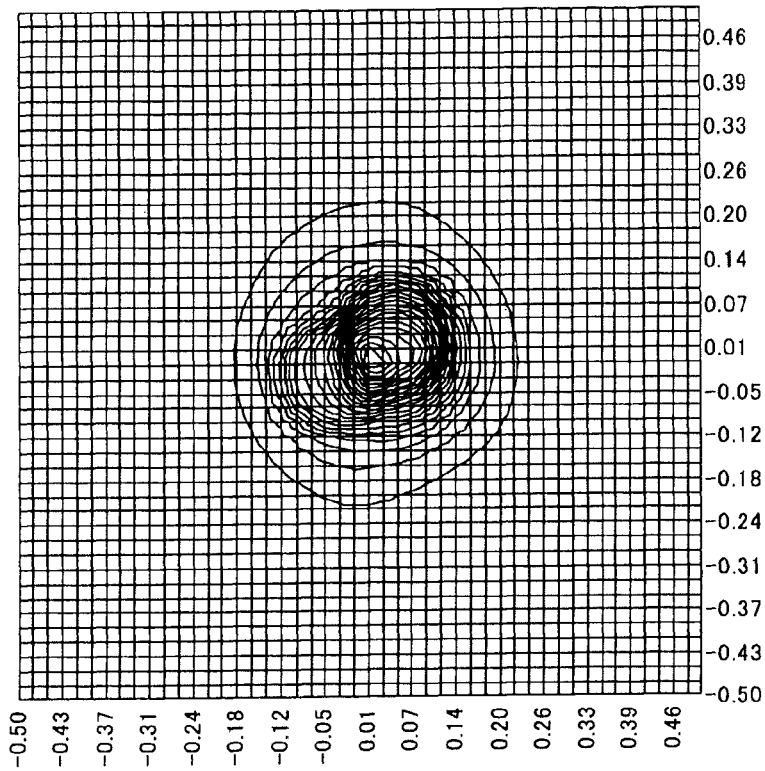
FIG. 12 is a schematic view of a light quantity distribution on the photosensitive drum when only one light emitting element is turned on and when one of the rod lenses has an error.
Figure 13:
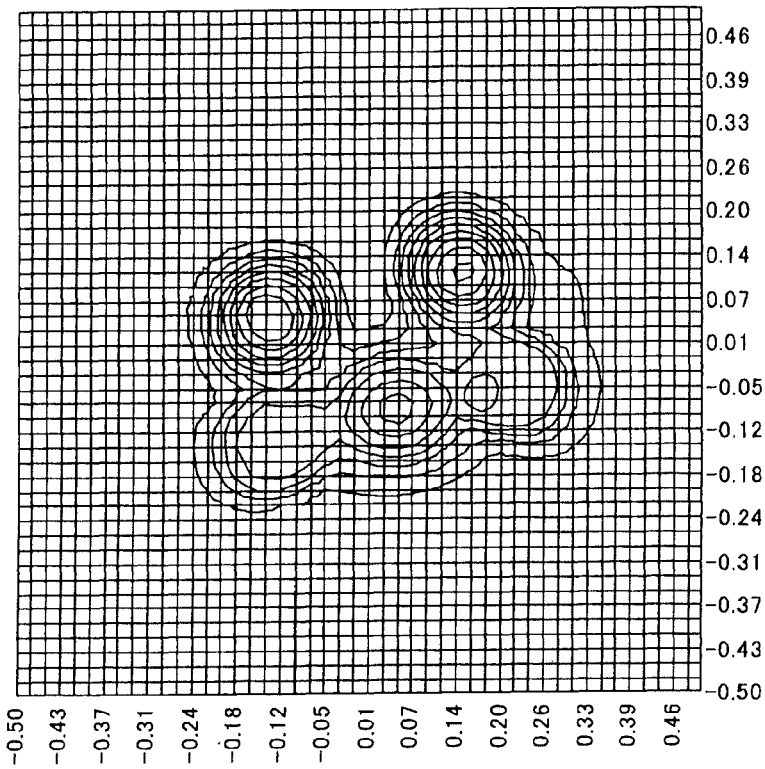
FIG. 13 is a schematic view of a light quantity distribution in the position defocused by −0.15 mm when only one light emitting element is turned on and when one of the rod lenses has an error.
Figure 14:
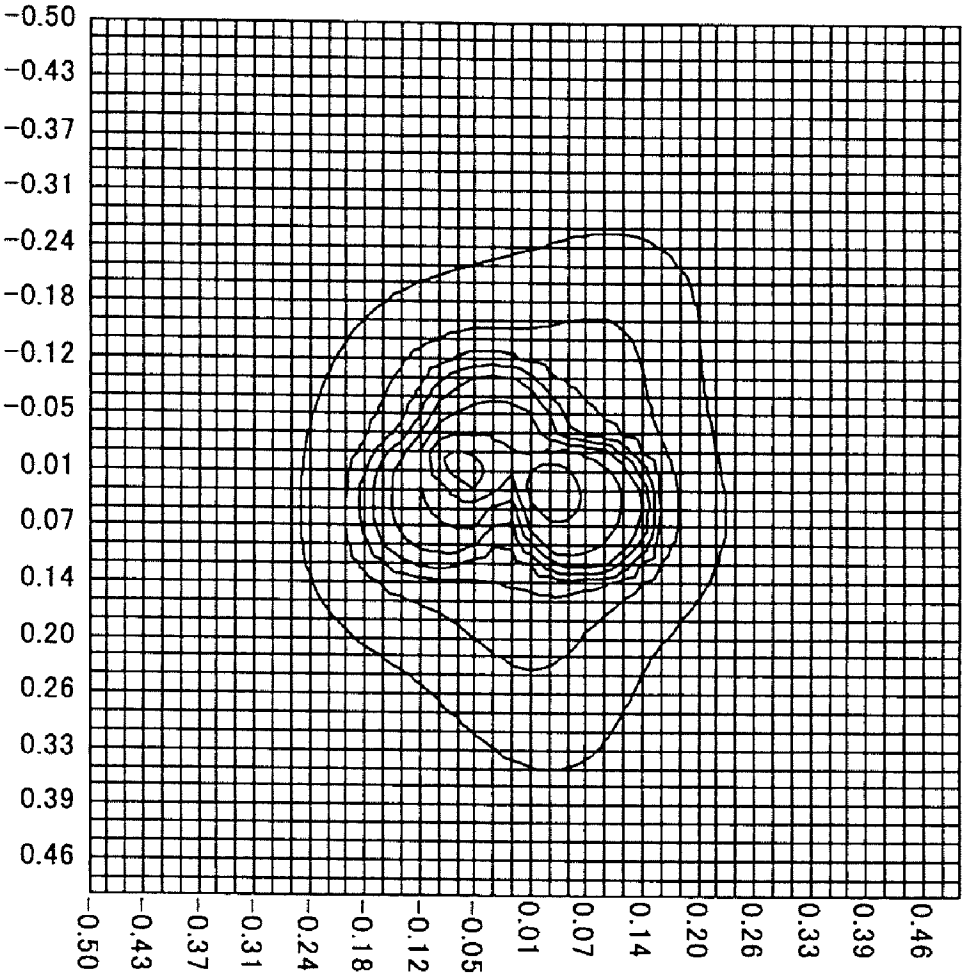
FIG. 14 is a schematic view of a light quantity distribution in the position defocused by 0.15 mm when only one light emitting element is turned on and when one of the rod lenses has an error.

FIGS. 12, 13 and 14 show the light quantity distribution on the photosensitive drum when only one light emitting element 1*a* is turned on and when one of the rod lenses 2*a* through which the light emitted from the light emitting element 1*a* passes has an error. FIG. 12 shows the light quantity distribution when the surface of the photosensitive drum 3 is on the focal point. FIG. 13 shows the light quantity distribution when the surface of the photosensitive drum 3 is defocused by −0.15 mm. FIG. 14 shows the light quantity distribution when the surface of the photosensitive drum 3 is defocused by 0.15 mm.

Figure 15:
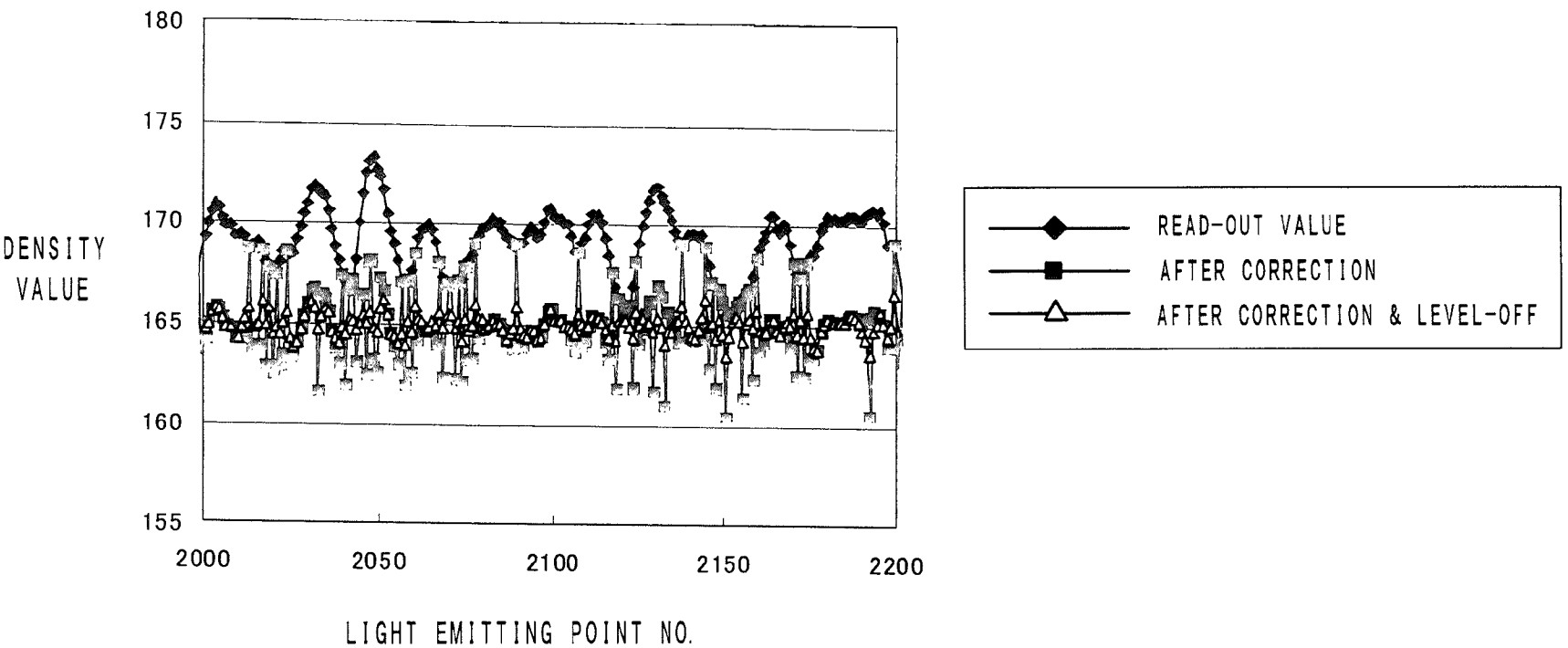
FIG. 15 is a graph showing values of the respective light emitting elements (at the light emitting points) including values read out by a scanner and values after adjustment.

Now, referring to FIG. 15, a specific example of adjustment is described. FIG. 15 shows density values with respect to the respective light emitting elements (points) 1*a*. In FIG. 15, values read out by a scanner are shown by diamond dots, values after a correction process are shown by square dots, and values after a correction process and a level-off process are shown by triangular dots.

The read-out values mean density values of a halftone image written by line screening, and here, the read-out values are obtained by reading the image with a scanner. When the read-out value is 255, it means white, and when the read-out value is 0, it means black. FIG. 15 shows only a part of the halftone image, and in this part of the image, the read-out values are around 170. The target value of the adjustment is 165.

In the part of the image shown by FIG. 15, the values after a correction process are obtained by adding correction values of zero, −1 step or −2 steps to the read-out values. One step corresponds to five in density value. In this part of the image, because the read-out values are generally high, positive correction values are not used. However, in the image entirely, correction values from −3 steps to +1 step are used. The values after a correction process, that is, the values obtained by adding correction values to the read-out values are not always equal to the target value, and the values even after the correction process are mostly larger or smaller than the target value. Therefore, with respect to each light emitting point, a total difference is obtained by adding the difference from the target value after the previous correction process to the difference from the target value before a current correction process. Then, a correction value to make the total difference closer to zero is used for the current correction process. For example, if the difference between a read-out value and the target value is +4, a correction value of −1 step (−5) is used, and in this case, the value after the correction process still differs from the target value by −1. That is, the difference from the target value after the correction process is −1.

The values after a correction process and a level-off process are values obtained by filtering the values after the correction process, and the filtered values are even compared with the originally read-out values. Practically, because an image formed by electrophotographic processes blurs more or less and because human eyes are not sensitive to high-frequency components, too fine gradation is not recognizable. In writing a halftone image by line screening, in a region with an even density, all the light emitting elements are turned on and turned off at a constant rate. Therefore, in order to obtain a satisfactorily even pattern, it is preferred to write an image by line screening.

In the experiment conducted by the inventors, a halftone image was written by line screening in the same way in which the halftone image that was subjected to data reading with a scanner was written, and it was proved that the light emitting elements were adjusted in light quantity such that the density unevenness would be minimized.

Figure 16:
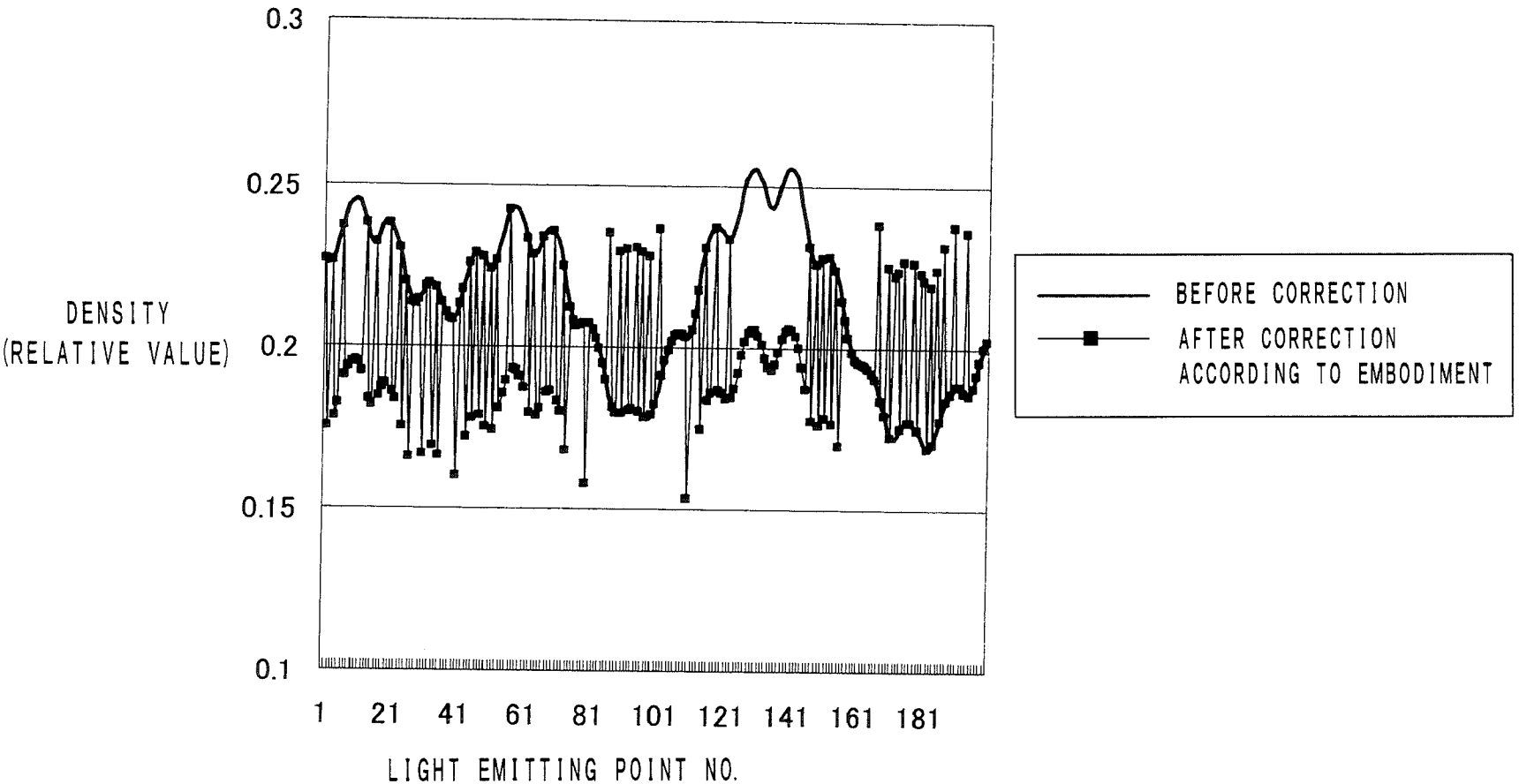
FIG. 16 is a graph showing density unevenness before a correction process in the case of FIG. 15 and density unevenness after a correction process according to an embodiment of the present invention.

FIG. 16 shows density unevenness and an example of correction according to an embodiment of the present invention. In FIG. 16, the thick curved line indicates density unevenness, and the square dots show the values obtained by adding correction values to the density values. The correction process is carried out by adjusting the light emitting elements 1*a* individually in light quantity such that the total difference from the target value will be closer to zero.

Thus, the density unevenness is corrected by adjusting the light emitting elements 1*a* individually in light quantity. However, it is not impossible to change the light quantity consecutively, and correction values are set by the density (relative value) of 0.05. With respect to each light emitting element 1*a*, the total difference is calculated by adding the difference from the target value of the value after the previous correction process to the difference from the target value of the value before the current correction process, and a correction value to make the total difference closer to zero is selected.

Figure 17:
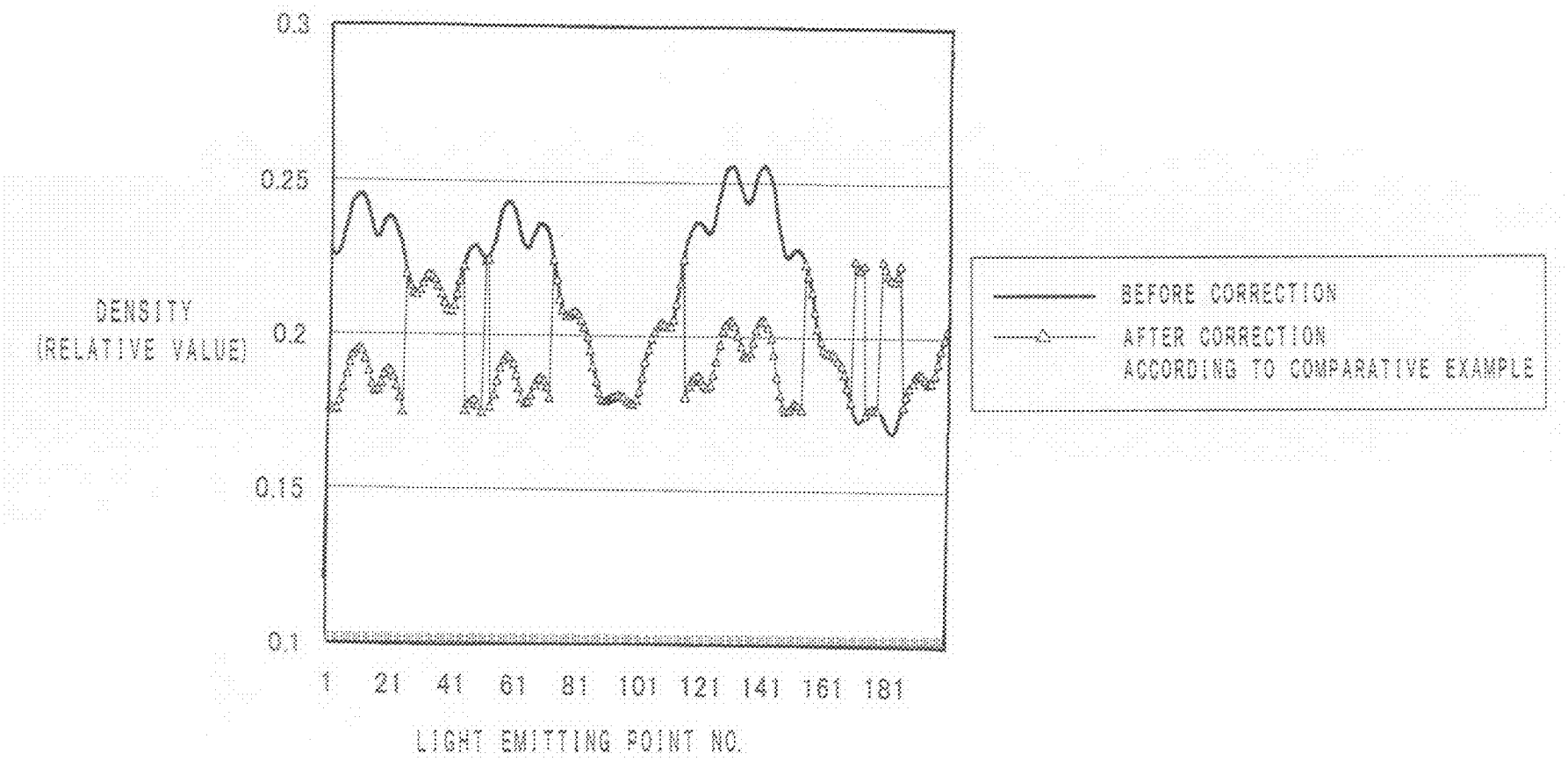
FIG. 17 is a graph showing the density unevenness before a correction process in the case of FIG. 15 and density unevenness after a correction process according to a comparative example.

FIG. 17 shows density unevenness and a comparative example of correction. In this comparative example, with respect to each light emitting element 1*a*, a correction value is selected such that the difference from the target value of the value before the current correction process will be closer to zero.

Figure 18:
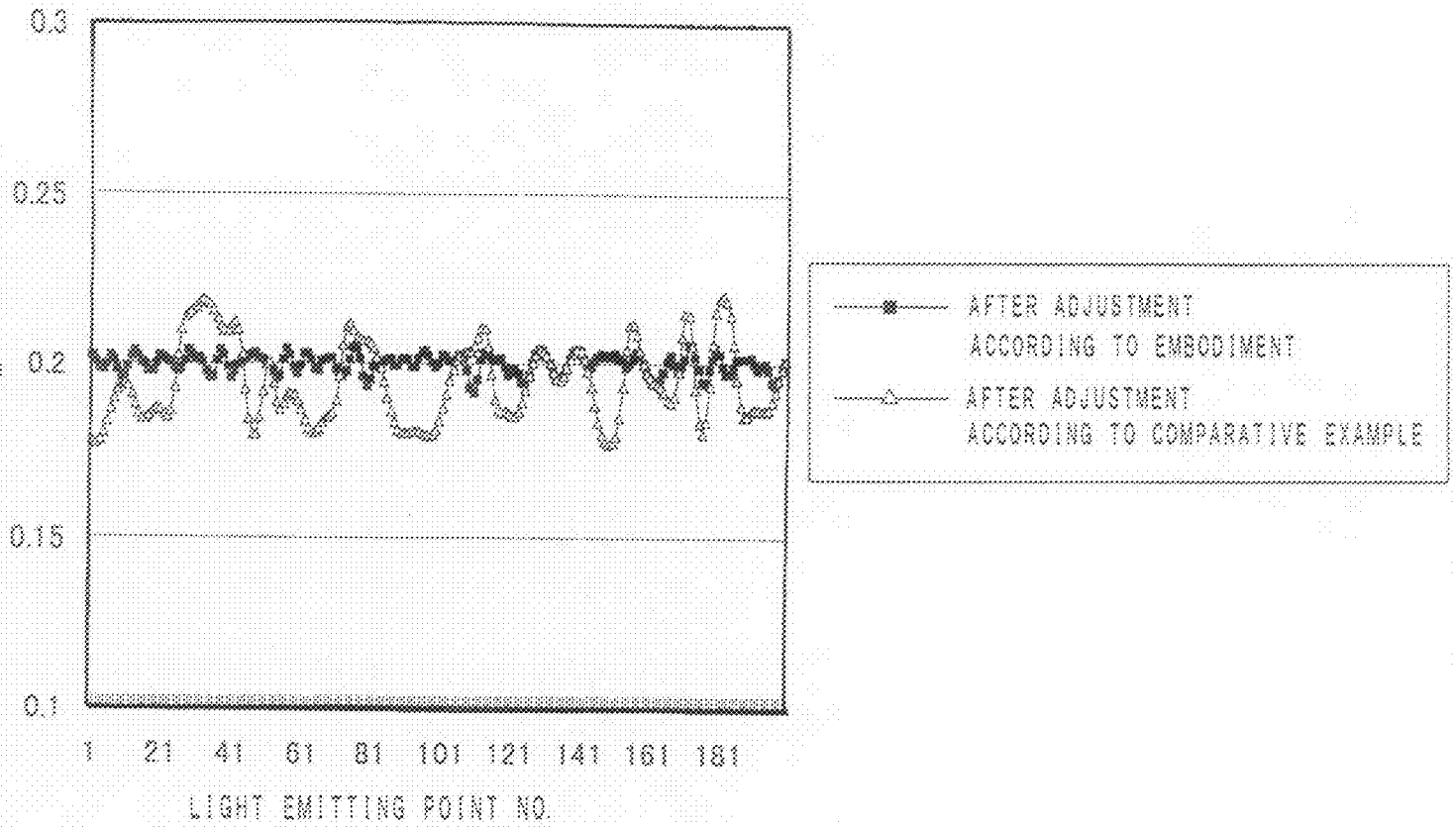
FIG. 18 is a graph for showing a comparison between the density unevenness after adjustment according to the embodiment of the present invention shown in FIG. 16 and the density unevenness after adjustment according to the comparative example shown in FIG. 17.

The values after the correction process according to the embodiment of the present invention are distributed to be higher and lower than the target value. However, in an image formed by electrophotographic processes, practically, high-frequency components cannot be reproduced, and the values become even. FIG. 18 shows a comparison between the correction according to the embodiment of the present invention shown in FIG. 16 and the correction according to the comparative example shown in FIG. 17, and the density values in FIG. 18 are values subjected to a filtering process as well as a correction process. As is apparent from FIG. 18, the correction according to the embodiment of the present invention lightens the density unevenness more than the comparative example.

In one way, data of density unevenness that will be used for correction are collected by scanning an outputted image. In another way, while the light emitting elements 1*a* are turned on one by one, the light quantity distributions on the respective focal points of the light emitting elements 1*a* are individually measured with a CCD or other measuring device, and data of density unevenness are calculated from the results of the measurement. In this case, the light quantity distributions are arranged in such a manner to agree with an image pattern to be written, and this arrangement is used to calculate the data.

Figure 19:
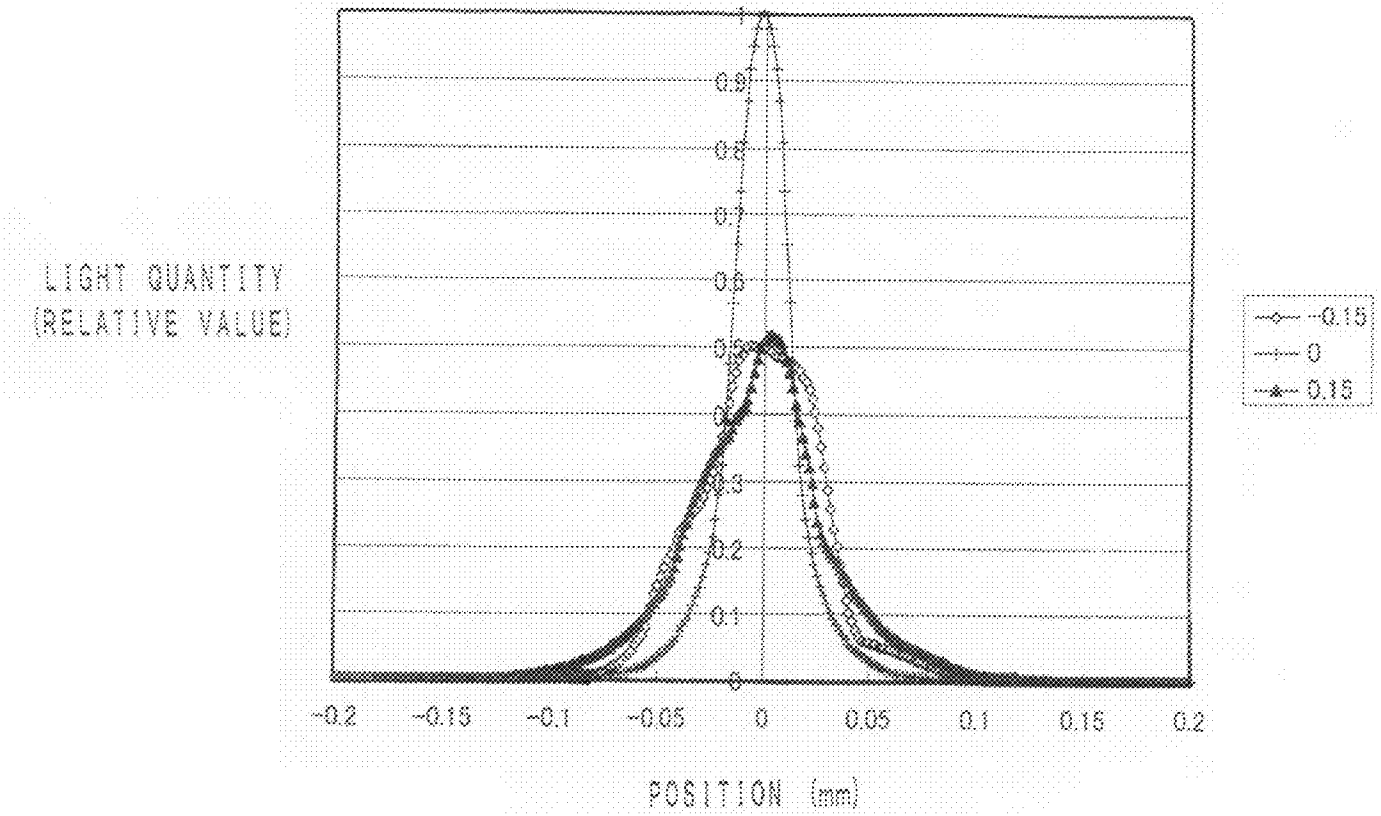
FIG. 19 is a graph showing measurement results of slit scanning according to the embodiment of the present invention.

Further, in another way, the light quantity distributions of the individual light emitting elements 1*a* are measured by use of slits. For example, a rotatable drum having slits on its surface and having sensors inside the slits is provided in a position corresponding to the photosensitive drum, and the light quantities of light passing through the slits are measured by the sensors. Thereby, one-dimensional light quantity distributions can be obtained. In this case, it is preferred that the angle of the slits agrees with the angle of line screening. FIG. 19 shows the light quantity distribution measured in this way, and the x-axis indicates the amount of defocus (mm). The results of the measurement are arranged in such a manner to agree with an image pattern to be written, and this arrangement is used to calculate the density unevenness.

Figure 20:
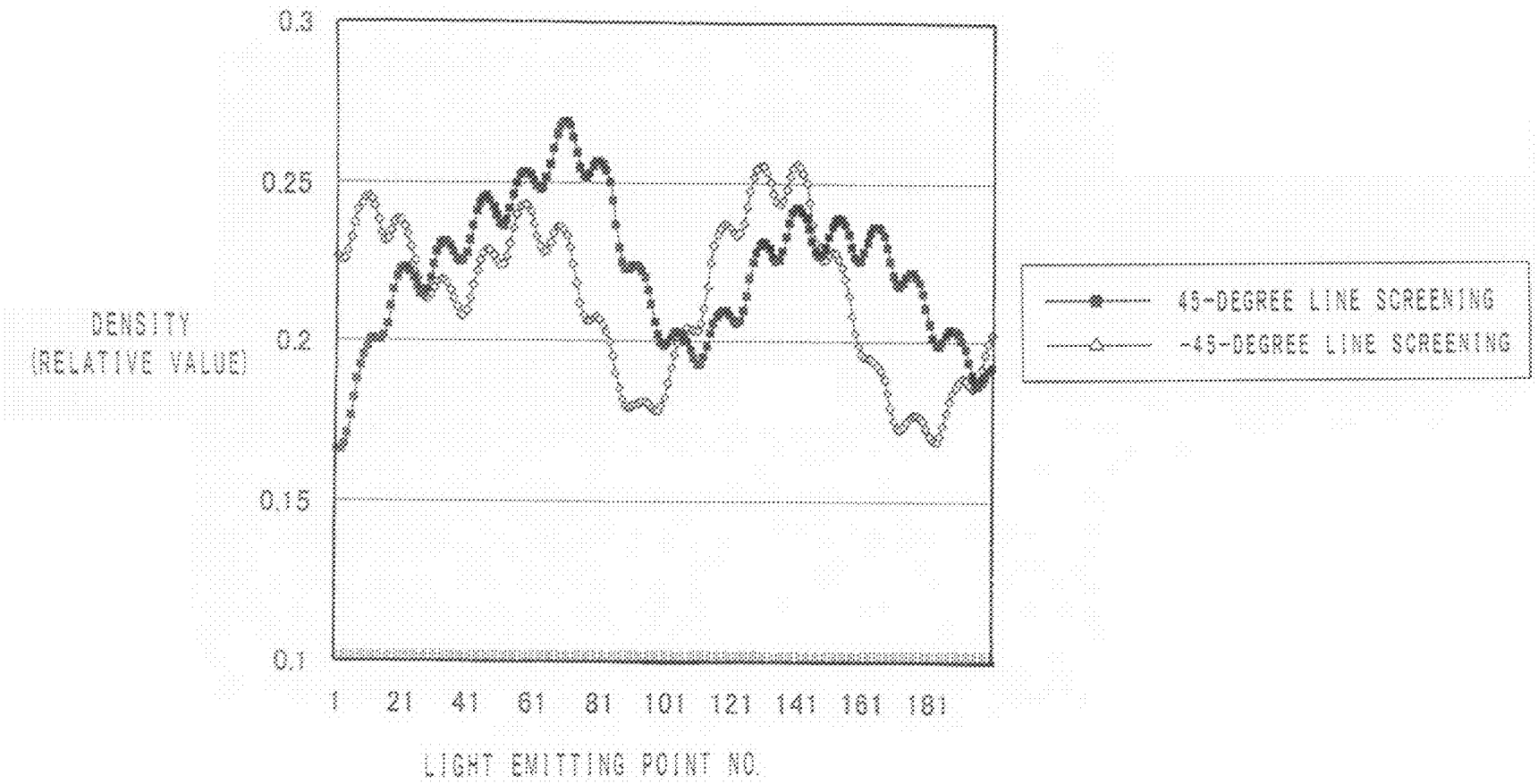
FIG. 20 is a graph showing a difference between images in density unevenness, depending on the angle of line screening used for the image writing.

As mentioned above, the light quantity distribution is influenced by the arrangement and the errors of the rod lenses 2*a*, and images of the same pattern written by line screening of different angles are different in density unevenness. FIG. 20 shows the density values of images written by two kinds of line screening (45 degrees and −45 degrees), in mutually corresponding portions. As is apparent from FIG. 20, the density unevenness differs depending on the angle of line screening. Therefore, for example, in apparatuses wherein the angle of line screening is changed in accordance with an image mode selected by a user, it is preferred that correction values are stored separately for the respective angles of line screening. The image modes are, for example, a letter mode, a photographic mode, a CAD mode, a gradation mode, a resolution mode, etc.

OTHER EMBODIMENTS

An image forming apparatus according to the present invention is not limited to the embodiment above.

For example, the light source is not necessarily an LED array and may be liquid crystal that can be partly turned on and turned off by switches.

Although the present invention has been described in connection with the preferred embodiments above, it is to be noted that various changes and modifications are possible to those who are skilled in the art. Such changes and modifications are to be understood as being within the scope of the invention.

What is claimed is:

1. An image forming apparatus comprising:

a light source comprising a plurality of light emitting elements aligned in a main-scanning direction;

a convergent lens array for imaging light emitted from the light emitting elements on a photosensitive member;

a controller for adjusting each of the light emitting elements in light quantity such that a total difference from a target value will be closer to zero.

2. An image forming apparatus according to claim 1, wherein line screening is used to write a halftone image.

3. An image forming apparatus according to claim 2, wherein the controller determines the target value based on results of image reading of a halftone image that was formed by line screening in a temporary condition to obtain even light quantities in a position after the convergent lens array while the light emitting elements are turned on one by one.

4. An image forming apparatus according to claim 2, wherein the controller determines the target value based on one-dimensional results of light quantity measurements carried out by use of slits of which angles agree with an angle of the line screening, the one-dimensional results of light quantity measurements showing imaging on the photosensitive member of light emitted from the respective light emitting elements while the light emitting elements are turned on one by one.

5. An image forming apparatus according to claim 1, wherein the controller determines the target value based on two-dimensional light quantity distributions, the two-dimensional light quantity distributions showing imaging on the photosensitive member of light emitted from the respective light emitting elements while the light emitting elements are turned on one by one.

6. An image forming apparatus according to claim 2, wherein images are formed by different kinds of line screening in different modes; and wherein the controller uses different correction values for different kinds of line screening.

* * * * *